United States Patent [19]

Kawai

[11] 3,939,899

[45] Feb. 24, 1976

[54] SHELL MOLDING MACHINE IN WHICH BLOWN CORE CAN BE EJECTED OUTSIDE VISE ASSEMBLY

[75] Inventor: Kiyomitsu Kawai, Osaka, Japan

[73] Assignee: Naniwa Products Co., Ltd., Osaka, Japan

[22] Filed: June 13, 1974

[21] Appl. No.: 479,125

[30] Foreign Application Priority Data

July 3, 1973 Japan ..... 48-75514

[52] U.S. Cl. ..... 164/181; 164/183; 164/186; 164/202

[51] Int. Cl.[2] ..... B22C 17/08; B22C 13/12

[58] Field of Search ..... 164/181, 183, 228, 185, 164/186, 200, 201, 202, 227, 22

[56] References Cited

UNITED STATES PATENTS

| | | | |
|---|---|---|---|
| 2,317,574 | 4/1943 | Williams | 164/181 |
| 2,901,791 | 9/1959 | Beech | 164/181 |
| 3,520,347 | 7/1970 | Von Wolff et al. | 164/186 X |
| 3,581,801 | 6/1971 | Hulslander | 164/22 |
| 3,589,431 | 6/1971 | Fellows | 164/181 X |
| 3,627,022 | 12/1971 | Shields | 164/183 X |

*Primary Examiner*—Ronald J. Shore
*Assistant Examiner*—John E. Roethel
*Attorney, Agent, or Firm*—Pennie & Edmonds

[57] ABSTRACT

A vertical split shell molding machine characterized by comprising hanging top board rails which are movably and fixably mounted to the top board of the principal body of said machine, a blow head assembly which is arranged movably beneath said hanging top board rails, an assembly which rotates a core box by 180° in the vise assembly, and an assembly which overturns a fixed core box outside the machine.

7 Claims, 4 Drawing Figures

SHELL MOLDING MACHINE IN WHICH BLOWN CORE CAN BE EJECTED OUTSIDE VISE ASSEMBLY

This invention relates to a shell molding machine, and more in particular to a shell molding machine having a vertical split core box, in which a core box can be rotated 180° in vise assembly, a system wherein a fixed core box is overturned outside the machine is provided, and core box exchange can be effected very easily.

In the shell molding machine having a vertical split core box in the present invention, the essential features of the invention are characterized by being provided with hanging top board rails which is mounted movably and fixably to the top board of the main body of said molding machine, a blow head assembly which is arranged movably below of said hanging top board rails, an assembly wherein the core box is rotated 180° in the vise assembly, and an assembly wherein the fixed core box is overturned outside the machine.

The molding machine according to the invention consists of the above-mentioned assemblies and has the operations referred to in detail below, and the principal functions and effects of the machine are as follows:

1. The machine can be separate blowing system which carries out a rollover drain by overturning, so that it is possible to make the machine a molding machine for massproduction of hollow shell cores by providing molding cavity by dividing the vertical split core box into two stages, upper and lower.

2. Since the fixed core box can be overturned outside the vise assembly to take out blown core, the ejecting direction of the blown core is not restricted and it is possible to eject out the core from any direction.

3. Since said hanging top board can be moved mounted with the blow head assembly, a sand feed assembly, a traverse cylinder and the like, the upper portion of the core box becomes an open state and the exchanges of both core boxes and blow-plate are easy.

4. A blown core conveying assembly is provided outside the vise assembly, so that the releasing and conveying of the blown core are easiler and more reliable than conventional machines in which they are effected at the lower side in an open stroke of the vice.

5. With the provision of a heating plate and core box setting plate between the core box and a die plate and of setting holes at the position except burner tip holes, it is possible to arrange multiple kinds of core boxes in smaller size, which arrangement has been impossible according to conventional means.

6. It is possible to change the moving and stopping positions of said blow head by varying the operation in item (4) above, so that it is also possible to mount one in which the thickness of the core box has been changed.

In conventional, known molding machines, machines such as mentioned below are known as molding apparatus which is provided with an assembly in which core box is rotated in vise and an assembly in which the core box is overturned outside the machine and blown core is released.

One example is a U-type shell core molding machine which is manufactured by Acme Cleveland Co. in the U.S.A. This molding machine is constructed in such a manner that a blow magazine is hung beneath a core box vise, said blow magazine is pressed against the blowing face of the core box to rotate the vise 180°, sands are blown into the core box by compressed air, the vise is overturned- return 180° to its original position so as to make the core hollow body, and the extra sands are collected in the magazine. This molding machine consists of the same principle as a dumping type shell molding machine by which known shell main mold is molded. In said molding machine the magazine rotates fixed to the vise so that blowing can be effected only once, and therefore since the blowing is not top-blowing unlike in the present molding machine it is quite impossible to blow at both the faces. Further, it will be easily understood by those skilled in the art that the said known shell molding machine has a disadvantage in which the core mold cannot be easily exchanged unlike in the present invention.

The present invention is explained in greater detail by way of an embodiment illustrated in the accompanying drawings, in which.

Figure 1:
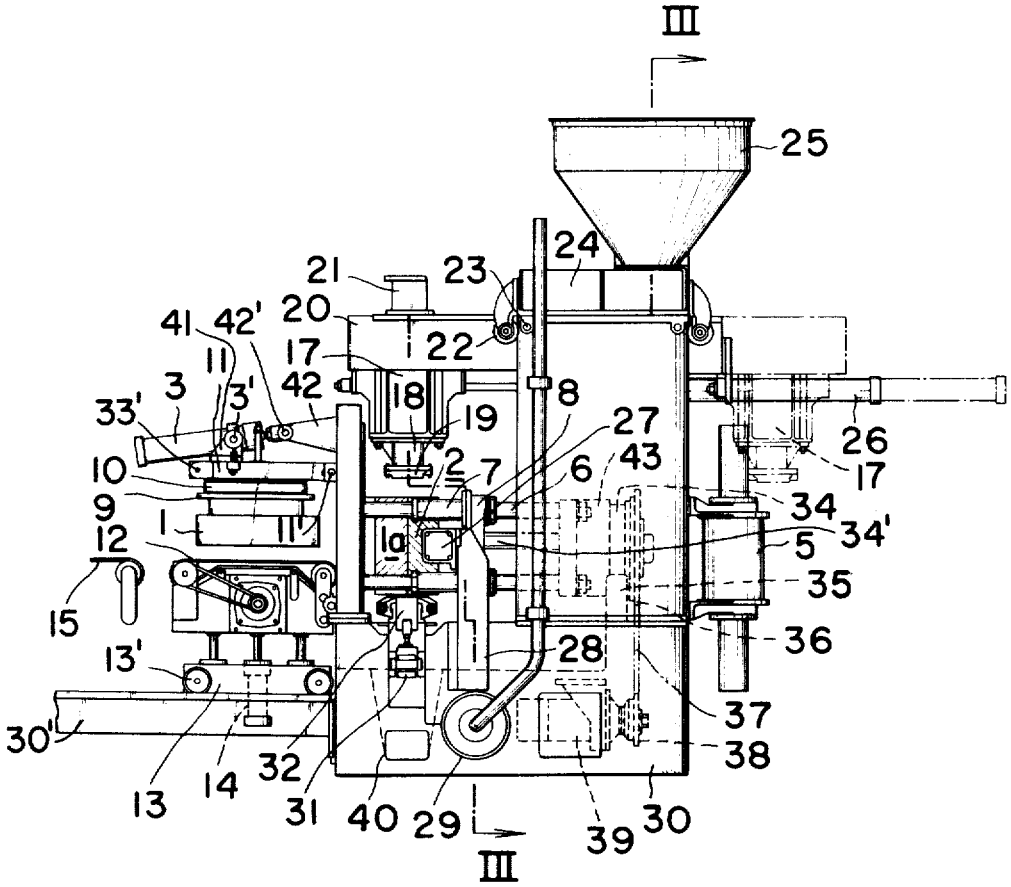
FIG. 1 is a side view showing an example of the shell molding machine of the invention.
Figure 2:
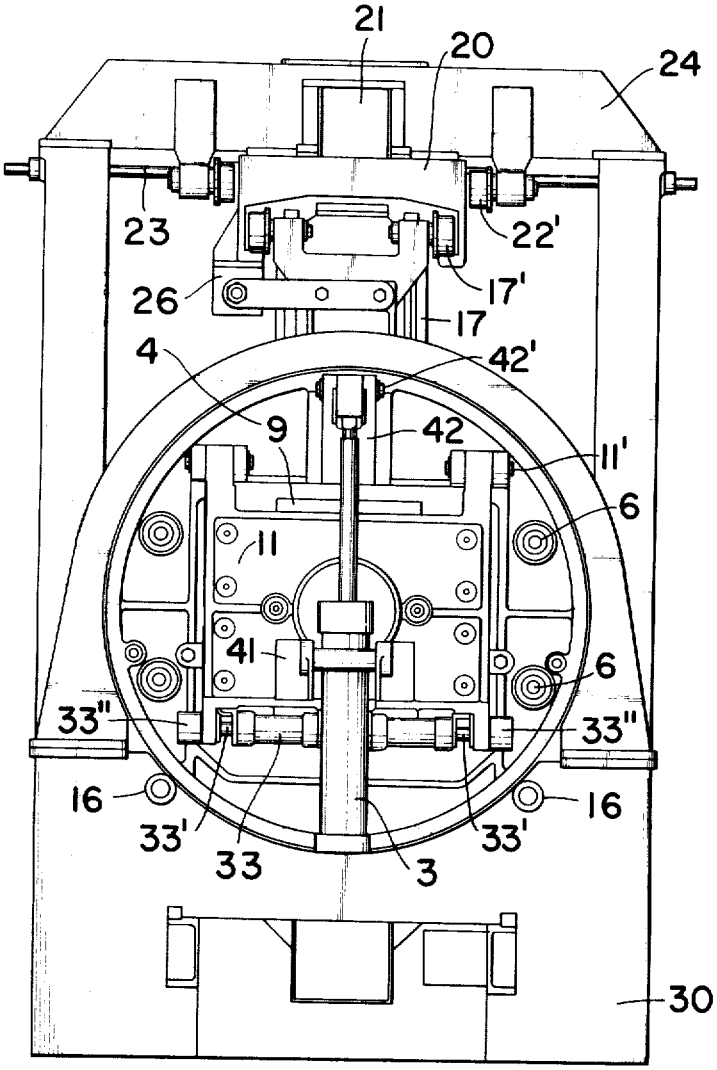
FIG. 2 is an elevational view.
Figure 3:
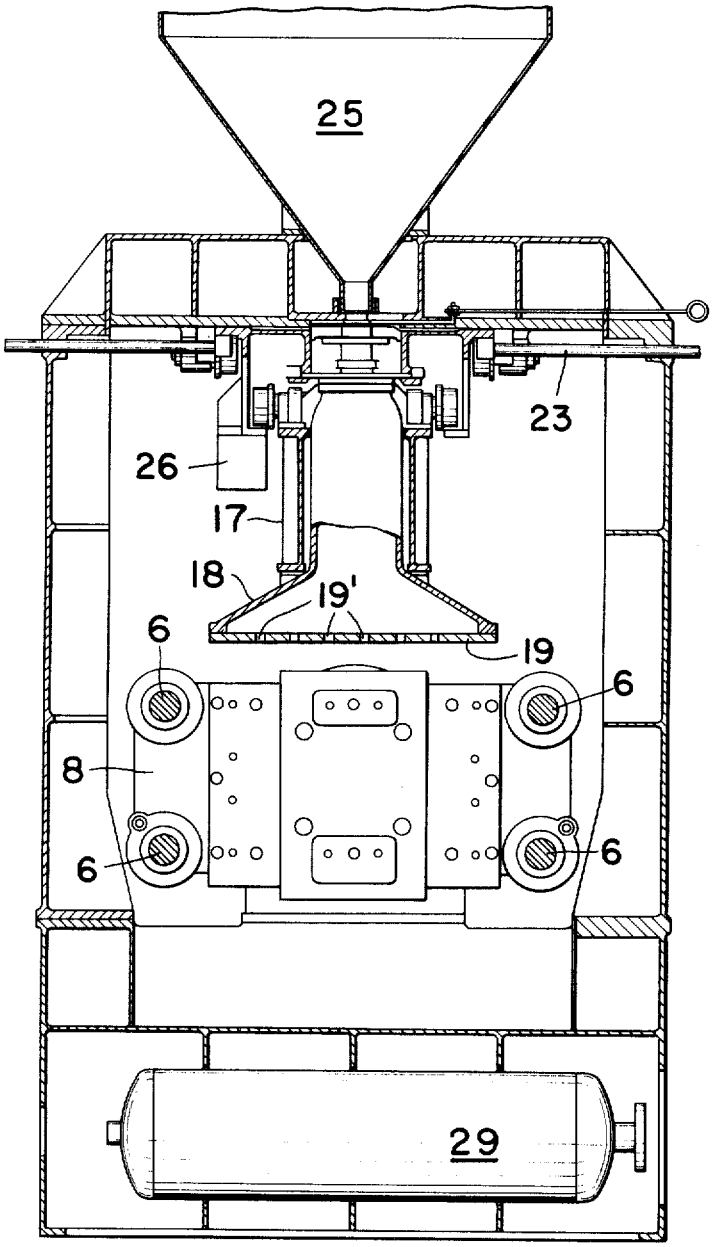
FIG. 3 is a cross-sectional view taken along the line III—III in FIG. 1.
Figure 4:
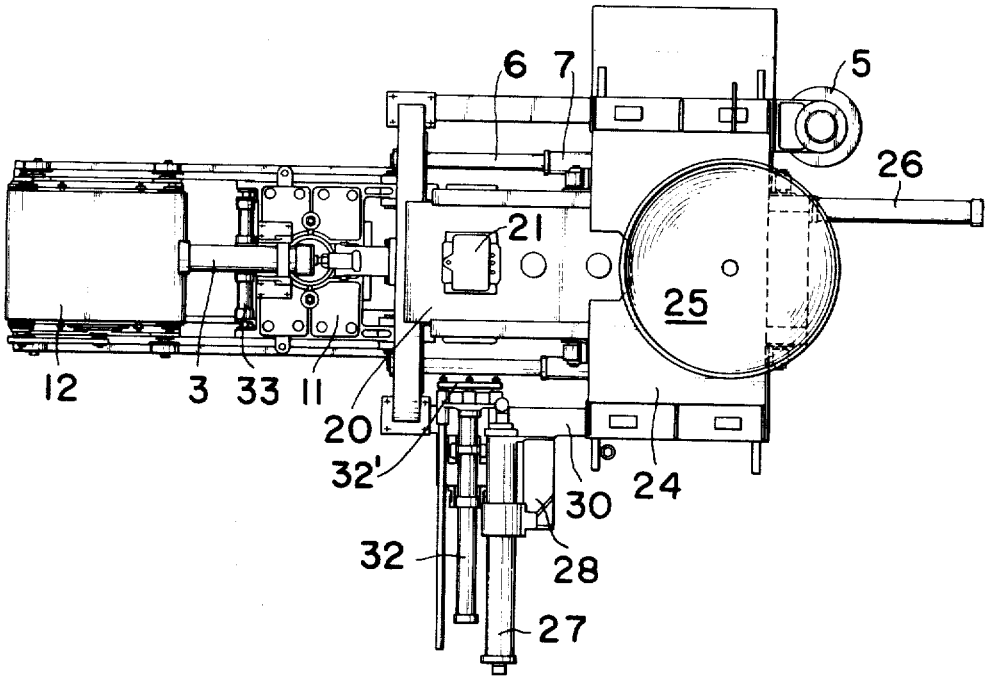
FIG. 4 is a plan view when the mold core is ejected downwards.

FIGS. 1 – 4 show a core box comprised of two halves 1 and 2. The core box half 1 is mounted from a die plate 11 which in turn is pivoted on pivot 11'. An hydraulic piston-cylinder assembly 3 is pivoted at 3' to a bracket 41 fixed to the die plate 11. The piston rod of the piston-cylinder assembly 3 is pivoted at 42' to a bracket 42 fixed to a rotating drum 4 (see FIG. 2) which is supported in the main frame 30 of the machine by means of rollers 16 for reasons hereinafter set forth.

By virtue of the pivotal mounting 11' for the die plate 11 and the core box portion 1, the core box portion 1 may be moved by the piston-cylinder assembly 3 between the positions indicated at 1 and 1a in FIG. 1. In the position indicated at 1a the core box portions 1 and 2 are mated and closed to form a complete core box for shell molding as hereinafter described.

Also supported from the rotary drum 4 at one end are four guide rods 6. At their opposite ends the guide rods 6 are supported in a second rotary drum 43. The rotary drum 43 is supported by rollers 35 in the main frame 30 for rotary motion with respect thereto. The guide rods 6 support a like number of guide sleeves 7 which in turn support a die plate 8 to which is secured by any conventional means the reciprocable or movable core box portion 2. It will be appreciated that the core box portions 1 and 2 may be changed for other like core box portions for molding different shapes and that such core box portions 1 and 2 are secured by known conventional means such as bolts or the like.

A second hydraulic piston-cylinder assembly 34 has the piston rod 34' thereof secured to the die plate 8 so that upon actuation of the piston-cylinder assembly 34 the die plate 8 and the core box portion 2 mounted thereon may be moved to and from the other core box portion 1 when it is in the position 1a shown in FIG. 1.

When the piston-cylinder assembly 3 is actuated to move the first core box portion 1 to the position shown at 1*a*, it is locked in position by a stopper cylinder assembly 33 (see FIG. 2) which extends locking rods 33' laterally to engage in suitable receptors 33'' on the drum 4 thus locking the die plate 11 and the core box portion 1 securely in the position shown at 1*a*. The numeral 9 indicates an ejector plate for ejecting cores from the core box portion 1, the details of which are not shown being well known in the art. Numeral 10 indicates a setting plate 10 having heating elements for heating the resin coated sand mixture in the core box to set the same as is also well known in the art.

It will be appreciated that when the piston-cylinder assembly 3 has been actuated and the core box portion 1 is in the position 1*a* shown in FIG. 1 and locked in place by the locking rods 33' that then the drums 4 and 43 together with the guide rods 6 interconnecting the same constitute a rotatable assembly referred to herein as the vise assembly since upon actuation of the piston-cylinder assembly 34 the core box portions 1 and 2 will be held tightly together as in a vise. Further, this vise assembly, comprising the drums 4 and 43 as well as guide rods 6 and their associated parts, may be rotated. For this purpose a sprocket 36 is mounted on the vise assembly and is rotatably driven by a chain 37 also trained about a driving sprocket 38 secured to the shaft of a suitable electric motor or reduction gear 39.

Above the vise assembly and mounted for reciprocating movement is a blow head car 17. The car 17 as rollers 17' journaled therein which engage rails 20 to support car 17 therefrom. The rails 20 are in turn supported by rollers 22 from a portion 24 of the main frame of the machine. In this manner the car 17 may be moved by means of the piston-cylinder assembly 26 from its solid line position shown in FIG. 1 to its dashed line position or to any chosen intermediate position. In its solid line position the blow car 17 positions its blow head 18 and blowplate 19 above the closed core box portions 1, 2 for filling the core box. By means of the piston-cylinder assembly 26, the car 17 may then be moved to an intermediate position beneath a hopper 25 for filling the car 17 from the hopper 25 with a suitable resin coated sand mix. The blow car 17 also carries a press cylinder 21 which operates in known manner. Since the operation of the press cylinder 21 is previously known from commercial devices, its structure is not shown in detail herein. Briefly, the piston-cylinder assembly 21 is provided with a compressed air reservoir for blowing resin coated sand from the blow head car 17 through the openings 19' (FIG. 3) of the blow plate 19 and into the molding cavity of the closed core box. Said piston-cylinder assembly 21 also includes a press cylinder to press the blow plate 19 onto the upper surface of the closed core box during the filling of the core box from the blow head car 17 as just described.

The support of the blow head car 17 by rollers 17' from the rails 20, which rails 20 in turn are supported by rollers 22 permit, as mentioned above, very considerable lateral movement of the blow head car 17 as viewed in FIG. 1. During normal operation the blow head car 17 is not moved to the extreme dashed line position shown in FIG. 1 but only from its solid line position shown in FIG. 1 to the intermediate position below the hopper 25. The blow head car 17 is moved to the dashed line position shown in FIG. 1 only when it is necessary to replace the blow head 19. Thus, in this dashed line position the blow plate is positioned well rearwardly of the entire device for easy accessability and replacement. The rods 23 serve to fix the rails 20 in the desired position by operation of handles (not shown).

After the core box 1*a*, 2 has been suitably filled with a sand mixture and set by heat, the vise assembly is rotated 180° by the gear reduction unit or prime mover 39 to invert the same. If the objects being molded are small enough, the core box halves 1, 2 may each be divided into upper and lower mold compartments independent of each other. In this configuration it is possible to be filling mold compartment in the top portion of the closed core box while the mold compartments in the bottom portion of the core box are disposed downwardly.

Subsequently, after setting the sand further rotation of the vise assembly by the prime mover 39 through 180° brings the mold compartments in the bottom portion to the uppermost position for filling from the car 17 as the mold compartments in the top portion are positioned lowermost and emptied of excess sand into the sand drain outlet or conveyor 40. When the core box 1, 2 is free of any excess sand and contains only the molded articles, the piston-cylinder assembly 33 may be activated to withdraw the locking rods 33' whereupon the piston-cylinder assembly 3 may be activated to rotate the core box portion 1 from the position indicated at 1*a* to the position indicated at 1 in FIG. 1. The ejection mechanism for the core box portion 2 insures that the molded articles are removed from the portion 2 and move with the core box portion 1 to the position shown in solid lines at 1 in FIG. 1.

A removing mechanism is provided for receiving ejected cores or molded articles from the core box portion 1. This conveyor comprises a continuous conveyor 12 supported on an unloading car 13 which is supported by the rollers 13' upon rails 30'. A piston-cylinder assembly 14 is arranged to raise and lower the assembly including the conveyor 12. The car 13 may be moved from its solid line position shown in FIG. 1 to the left where it will cooperate with the conveyor 15 transferring thereto the cores previously received upon the conveyor 12 from the core box portion 1 upon actuation of the ejector mechanism 9 (the operation of which ejector mechanism 9 is old and well known). No means for moving the car 13 as above described is shown since such mechanism is previously well known in machines of this type.

It will be appreciated that while FIG. 1 shows the ejection of the mold cores downwardly from the core box portion 1, such is a function of the degree to which the vise assembly including the drums 4 and 43 is rotated. That is to say that after emptying of all excess sand into the removing conveyor 40, the prime mover 39 may be operated to position the rotary drums 4 and 43 in any desired position including positions wherein the core box portion 1 is laterally disposed (toward the left or toward the right) or even upwardly disposed. In any of these positions, or any position intermediate therebetween, the ejector mechanism will be effective to eject the mold cores from the core box portion 1 from which they will then fall upon the conveyor 12.

A scraper 32' (FIG. 4) is mounted at the end of the piston-cylinder assembly 32. The piston rod of piston-cylinder assembly 32 moves the scraper to and fro (up and down in FIG. 4) in order to pass the scraper 32' over the open mold halves 1 and 2 after each molding operation. Since different molds may be positioned at different positions vertically the piston-cylinder assembly 31 is provided to adjust the scraper 32' as well as the piston-cylinder assembly 32 vertically. Further cleaning is effected by means of a duster mounted on the end of the piston rod of the piston-cylinder assembly 27 also in known manner.

What is claimed is:

1. A shell molding machine comprising a fixed frame, a blow head assembly supported from said fixed frame, said blow head assembly including an outlet, a vise assembly supported rotatably by said fixed frame below the outlet of said blow head, a pair of cooperating mold halves, said mold halves being mounted in said vise assembly, one of said mold halves being pivoted with respect to said vise assembly, means for pivoting said one mold half from a first position adjacent to the other of said mold halves to a second position substantially exterior of said fixed frame for ejection of molded articles from said one mold half, and means for so ejecting said articles when said one mold half is in said second position.

2. The shell molding machine of claim 1 including means mounted from said vise assembly for clamping said mold halves together to form a core box having an inlet.

3. The shell molding machine of claim 2 including means for rotating said vise assembly from a position in which said inlet of said core box is positioned below the outlet of said blow head assembly to receive material therefrom to a position for dumping excess material from said core box outwardly through said inlet by gravity.

4. The shell molding machine of claim 3 in which said means for rotating said vise assembly rotates said assembly through at least 180°.

5. The shell molding machine of claim 1 in which said blow head assembly is supported from said fixed frame by means of rails and rollers for rectilinear movement with respect to said frame.

6. The shell molding machine of claim 5 including a feed hopper and said blow head assembly being moveable from a first position for filling said core box to a second position beneath said hopper for filling of said blow head assembly from said hopper.

7. The shell molding machine of claim 6 in which said blow head assembly is also moveable to a third position sustantially exterior of said fixed frame.

* * * * *